United States Patent [19]

Cunningham et al.

[11] Patent Number: 5,044,432

[45] Date of Patent: Sep. 3, 1991

[54] WELL PIPE HANGER WITH METAL SEALING ANNULUS VALVE

[75] Inventors: Christopher E. Cunningham, Edinburgh; Rolf A. Ruesse, Fife, both of Scotland

[73] Assignee: FMC Corporation, Chicago, Ill.

[21] Appl. No.: 566,009

[22] Filed: Aug. 10, 1990

[51] Int. Cl.[5] ..... E21B 33/04

[52] U.S. Cl. ..... 166/87; 166/206; 166/332; 285/133.2; 285/141

[58] Field of Search ..... 166/86, 84, 206, 208, 166/316, 332; 285/133.2, 137.2, 140–142

[56] References Cited

U.S. PATENT DOCUMENTS

| | | | |
|---|---|---|---|
| 3,489,215 | 1/1970 | Regan | 166/87 |
| 3,625,283 | 12/1971 | Ahlstone | 166/87 |
| 3,638,725 | 2/1972 | Ahlstone | 166/87 |
| 3,797,864 | 3/1974 | Hynes et al. | 285/140 |
| 4,125,155 | 11/1978 | Brock, Jr. | 166/87 |
| 4,324,422 | 4/1982 | Rains et al. | 166/87 |
| 4,449,583 | 5/1984 | Lawson | 166/87 |
| 4,471,965 | 9/1984 | Jennings et al. | 277/26 |
| 4,568,062 | 2/1986 | Regitz et al. | 251/328 |
| 4,697,828 | 10/1987 | Chou | 285/141 |
| 4,714,111 | 12/1987 | Brammer | 285/141 |
| 4,807,700 | 2/1989 | Wilkins | 166/86 |
| 4,869,318 | 9/1989 | Kellett | 166/87 |
| 4,903,774 | 2/1990 | Dykes et al. | 166/363 |

FOREIGN PATENT DOCUMENTS

| | | |
|---|---|---|
| 2214543 | 6/1989 | United Kingdom . |

*Primary Examiner*—Bruce M. Kisliuk

*Attorney, Agent, or Firm*—W. William Ritt, Jr.; Richard B. Megley

[57] ABSTRACT

A well pipe hanger with a metal sealing annulus valve comprising an axially positionable annular metal seal element with a pair of radially spaced annular sealing surfaces that cooperate with annular metallic sealing surfaces on adjacent well elements to establish a metal-to-metal seal between said elements.

27 Claims, 4 Drawing Sheets

WELL PIPE HANGER WITH METAL SEALING ANNULUS VALVE

BACKGROUND OF THE INVENTION

This invention relates to well pipe hangers, and more particularly to concentric tubing hangers for use in wells requiring positive lock down of the hanger and control of the well annulus below the hanger.

General safety and operational requirements for oilfield tubing and casing hangers impose several constraints on the design of the hangers, the wellheads and the other well components with which the hangers cooperate. Some of the more important features of these hangers comprise sealing devices at various locations, such as between the hanger and the wellheads and/or the Christmas tree, and within the hanger bores themselves, to isolate pressure below the hanger; a positive locking device to prevent accidental release of the hanger from the wellhead, such as due to trapped pressure below the hanger or thermal expansion of well tubulars; and conduit(s) through or around the hanger for control of the well production/injection annulus below the hanger. Earlier hangers, specifically tubing hangers, were not required to effect metal seals between the interfacing components primarily due to the fact that accepted technology in this area did not exist, but metal seals are now commonly specified by operators. Although some hangers with metal elements for providing access to or isolation of the annulus, such as sliding sleeves or poppet rings, are known, the sealing components in those designs are totally resilient in nature and, therefore, do not satisfy specifications calling for metal-to-metal sealing at that location.

SUMMARY OF THE INVENTION

The present invention comprises a concentric pipe hanger, specifically a tubing hanger, with a mechanism for rigidly locking the hanger in a surrounding well element, and a metal sealing concentric annulus closure system.

The locking mechanism components include a locking mandrel that surrounds the tubing hanger body and is axially movable with respect thereto, an axially-split hanger locking ring surrounding the hanger body beneath the mandrel, and a sleeve-like reaction ring surrounding and threaded to the hanger body beneath the locking ring. As the locking mandrel is moved downwardly with respect to the tubing hanger body the mandrel forces the locking ring to expand into an opposing annular groove in the bore surface of the wellhead or other well component (henceforth referred to as the "hanger receptacle") in which the hanger has been landed, and hoop compression of the locking mandrel combines with axial compression of the reaction ring to rigidly lock the tubing hanger to the hanger receptacle. The load path for holddown of the tubing hanger in the hanger receptacle passes through the hanger landing seat, the hanger body, the reaction ring, the locking ring (backed up by the locking mandrel), and into the hanger receptacle body. There is effectively no "slop" in this load path since the reaction ring is pre-positioned on the hanger body so that the hoop compression of the locking mandrel results upon expansion of the locking ring into its groove in the hanger receptacle. This deflection of the locking mandrel compensates for any tolerances which might have occurred in machining the hanger locking profile in the hanger receptacle, as well as in the hanger mechanism itself. The hoop compression of the locking mandrel creates a substantial frictional force between the mandrel and the locking ring such that, combined with a flat-to-flat interface between the mandrel and the ring, no special locking devices are required to maintain the hanger locking mechanism secure. Furthermore, the resulting rigid lockdown of the hanger in the hanger receptacle against annulus pressure and thermal expansion of the well tubulars promotes long life for the hanger-to-hanger receptacle seals, as well as the hanger-to-Christmas tree seals.

The metal sealing concentric annulus closure system comprises a toroidal metal annulus valve element and a pair of opposed annular sealing surfaces in an annular chamber in the hanger body. The chamber is in fluid communication with the well annulus between the suspended tubing string and the well casing below the hanger, and is open at its upper end to the interior of the hanger body. The valve element is located in this annular chamber so that by movement of a hanger running and retrieving tool or other well tool such as a Christmas tree connector, the valve element can be shifted axially between its open and closed positions to control access to that well annulus. The valve element includes inner and outer sealing lips with radiused sealing surfaces, an annular rib to connect the valve element with a well tool for moving the element into its open and closed positions, and annular stop surfaces that cooperate with annular stop surfaces on the hanger to prevent further axial movement of the element once it has reached its desired open or closed position. The valve element requires no specific orientation for make-up of well completion components, and the hanger does not require a self-contained hydraulic actuating mechanism which would deteriorate with time and subsequently require retrieval of the hanger for repairs.

The annulus valve of the present invention enables use of an emergency pump-down procedure to "bullhead" the valve element from above into its open position should the primary operating system fail. This same procedure can be used in a somewhat more subtle manner by balancing pressure across the valve element (by applying pressure on top) before opening the valve, thereby enhancing the life-span of the metal annulus seal.

Another feature of the annulus valve of this invention is that it facilitates testing of the annulus closure from below, namely by pressurizing the annulus, closing the valve, and monitoring bleed back, a standard offshore operation. Testing of the annulus from below is highly desirable and not possible with the tubing-installed plugs that are commonly used for more conventional oriented type (tubing) hanger completions.

The metal sealing concentric annulus valve of the present invention provides a level of sealing confidence which previously has not been available. Because it is a metal, as opposed to resilient, type seal it is not susceptible to explosive decompression in gas service. Also, the concentric configuration of this annulus closure mechanism enables the use of a totally non-orienting well completion system that offers significant cost advantages, such as those resulting from simplified manufacturing requirements and simplified field operations, as compared with oriented designs.

DESCRIPTION OF THE PREFERRED EMBODIMENT

Figure 1:
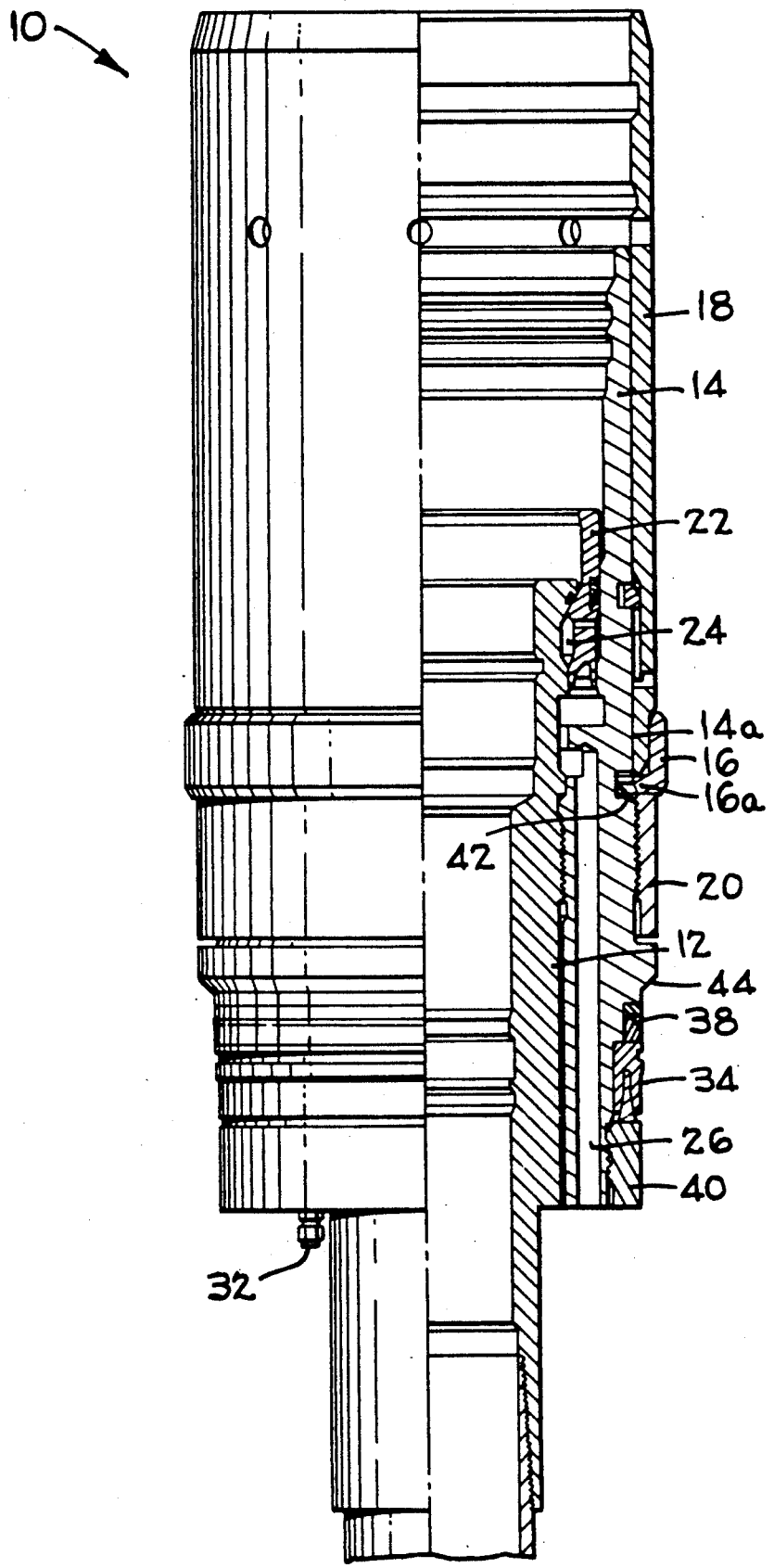
FIG. 1 is a view in elevation, with the right half in central section, of a well tubing hanger with a hanger locking mechanism and a metal sealing annulus valve according to the present invention.
Figure 2:
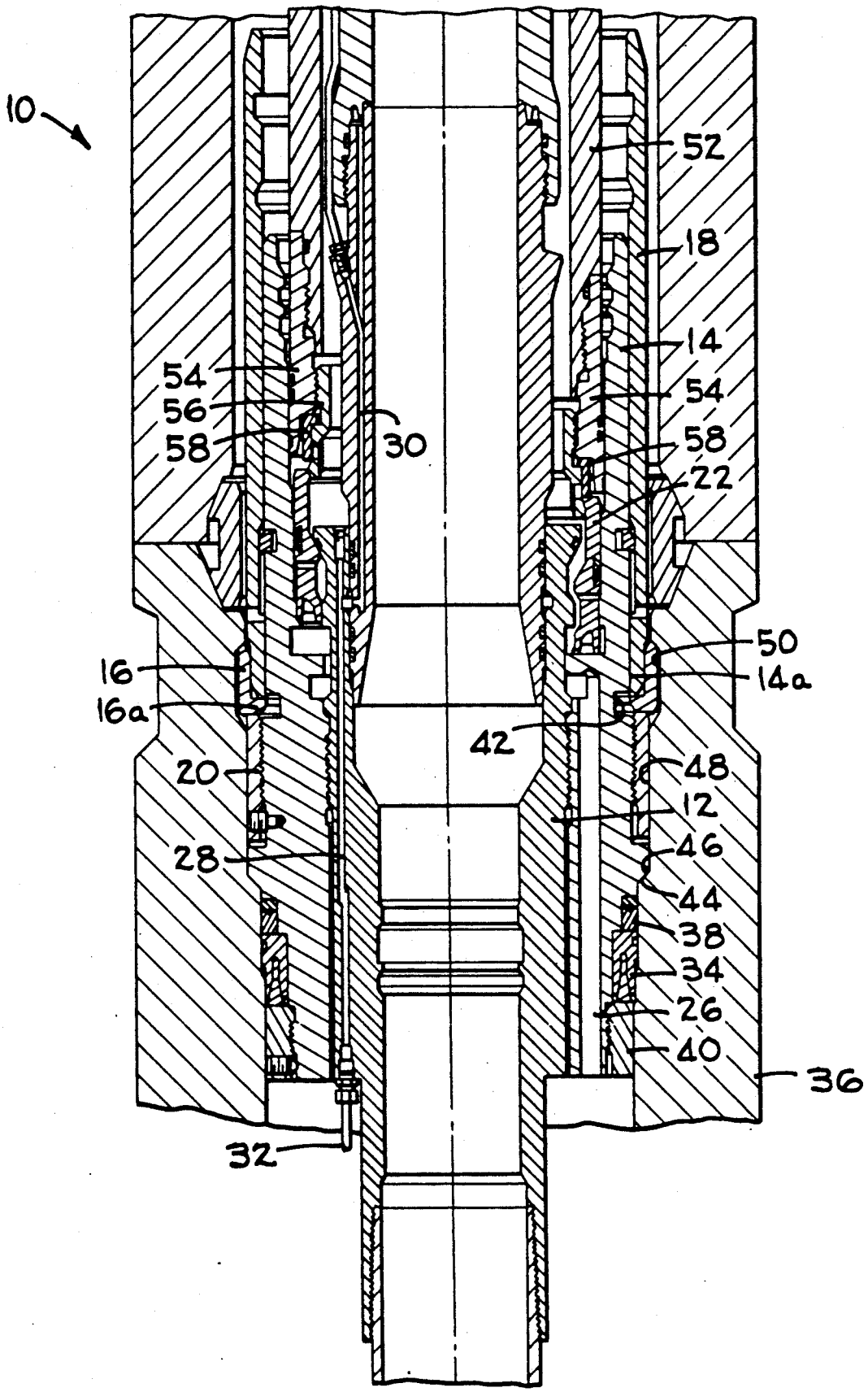
FIG. 2 is a central vertical section of the hanger of FIG. 1 installed in a subsea wellhead, with lower portions of an annulus valve operating sleeve and a production seal extension sub in functional position in the hanger, and with the annulus valve shown in its closed and open positions in the left and right halves, respectively, of said FIG. 2.

As illustrated in FIGS. 1 and 2, a well tubing hanger 10 incorporating the features of the present invention includes an inner body 12, an outer body 14 surrounding and threaded to the inner body 12, an axially-split hanger locking ring 16 surrounding the outer body 14, a locking mandrel 18 surrounding the outer body 14 above the ring 16 and axially movable with respect to the body 14, a reaction ring 20 surrounding and threaded to the outer body 14, and an annular metal annulus valve element 22 located in an annular chamber 24 between the inner and outer hanger bodies 12, 14. A longitudinal passageway 26 provides communication between the chamber 24 and the well annulus below the hanger 10, and another longitudinal passageway 28 (FIG. 2) interconnects hydraulic line 30 coming from a surface location (not shown) with a hydraulic line 32 that extends to a downhole safety valve or other downhole tool (not shown). Additional similarly configured passageways/ports through the hanger can be included if desired. The hanger 10 also includes an annular metallic seal assembly 34 that functions as a primary metal-to-metal seal between the hanger and a wellhead housing or other hanger receptacle 36 (FIG. 2) in which the hanger resides, an annular resilient seal assembly 38 providing a secondary seal between the hanger and wellhead housing (or other hanger receptacle), and a seal retainer ring 40 threaded or otherwise secured onto a lower end portion of the hanger body 14.

The tubing hanger locking ring 16 has an L-shaped cross-sectional configuration and is inherently biased into a contracted position (not shown) against the outer surface 14*a* of the hanger outer body 14 prior to descent of the locking mandrel 18 into its locking position shown in FIGS. 1 and 2. The ring 16 has an inwardly extending flange-like foot portion 16*a* that resides in a groove 42 in the hanger outer body 14 when the ring is contracted (not shown). Following landing of the hanger 10 in the wellhead housing (or other hanger receptacle) 36, whereby an external annular shoulder 44 on the hanger rests on an internal annular seat 46 (FIG. 2) in the receptacle bore 48, the locking mandrel is moved downward to cam the ring outward into its expanded position in an annular groove 50 in the receptacle bore 48, thereby locking the hanger to the receptacle. Should release of the hanger 10 from the hanger receptacle 36 be desired, the locking mandrel 18 is lifted from behind the ring 16, thereby allowing the ring to contract out of the groove 50.

In the above-described steps of landing and locking the hanger 10, the hanger body 14, the hanger locking mandrel 18, the hanger locking ring 16, the reaction ring 20 and the surrounding wellhead housing 36 cooperate to create hoop deflection of the locking mandrel to generate a pre-load in the locking system when functionally engaged. The concept of hoop deflection, an engineering term in common usage in the oil and gas industry and explained at length in Roark & Young's "Formulas for Stress and Strain", 5th Edition, McGraw/Hill, applies the principle that metal is flexible, i.e., can be stretched and compressed, to cylindrical bodies. When metal is stretched or compressed (deflected) a force-generating capacity (potential energy) equal to and opposite in direction to the stretching/compressing force is stored in the material, as in a spring, such that when the stretching/compressing force is removed the material can return to its original configuration. It is this stored energy that is commonly referred to as "pre-load".

The metal annulus valve element 22 of the annulus closure system comprises a central annular body 22*a*, inner and outer annular sealing lips 22*b*, 22*c*, respectively, that extend downward from the body portion 22*a*, and an annular rib 22*d* that faces inwardly from the upper end area of the body 22*a*. As seen best in FIGS. 5 and 6, each of the sealing lips 22*b*, 22*c* has an annular sealing surface 22*e*, 22*f*, respectively, with a radiused configuration that assures a pressure-tight metal-to-metal seal with adjacent annular sealing surfaces 24*a*, 24*b* of the chamber 24 when the valve element is in its closed position shown in FIGS. 3, 4 and 8. The lower portion of each chamber sealing surface 24*a*, 24*b* is chamfered to facilitate movement of the lip sealing surfaces 22*e*, 22*f* onto the chamber sealing surfaces as the valve element 22 is lifted into its closed position, and when in that position the lip sealing surfaces are in an interference fit relationship with the opposing chamber sealing surfaces.

The annulus valve element 22 is moved between its open and closed positions by a well tool such as the annulus valve operating sleeve 52 illustrated in FIG. 2. As best seen in FIGS. 3–8 the sleeve 52 includes a tubular mandrel 54 to which is threaded a valve retractor ring 56, and a stop ring 58 of L-shaped cross-sectional configuration secured in place against a lower radial face 54*a* of the mandrel 54 by the retractor ring 56. As the sleeve 52 is lowered to open the annulus, an annular outward-facing rib 60 on the lower end of the retractor ring 56 pushes against the rib 22*d* to move the annulus valve element 22 downward from its FIG. 4 closed position through its position shown in FIG. 5 and into its fully open position, as seen in FIG. 6, wherein the bottom surfaces of the valve sealing lips 22*b*, 22*c* have come to rest against an upwardly facing annular stop surface 62 on the hanger outer body 14. In the FIG. 6 position of the annulus valve element 22 the well annulus below the hanger is in full open communication with the hanger bore above the valve.

Figure 5:
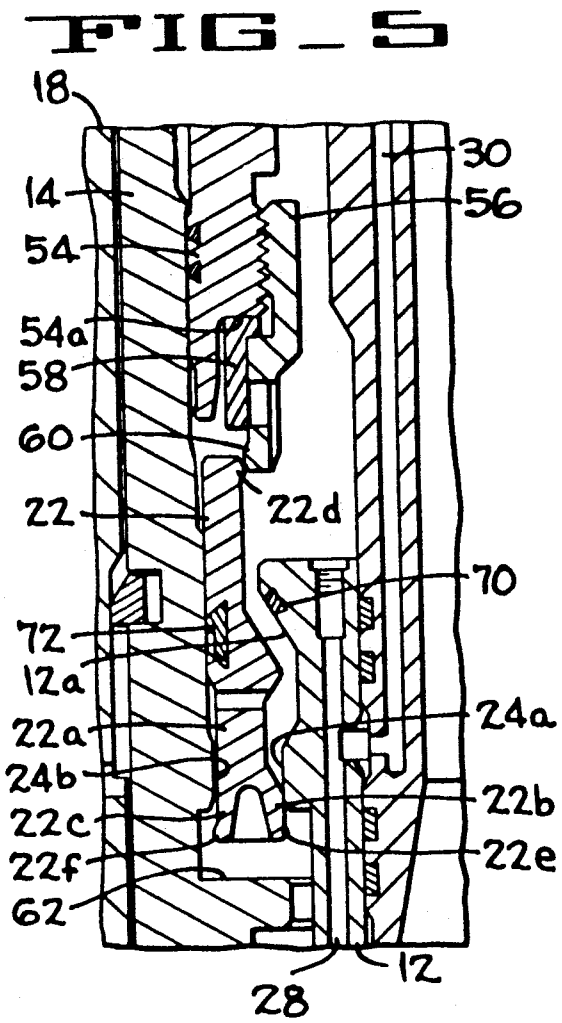
FIG. 5 is a view like FIGS. 3 and 4, but showing the annulus valve mid-way in its movement toward its fully open position.
Figure 6:
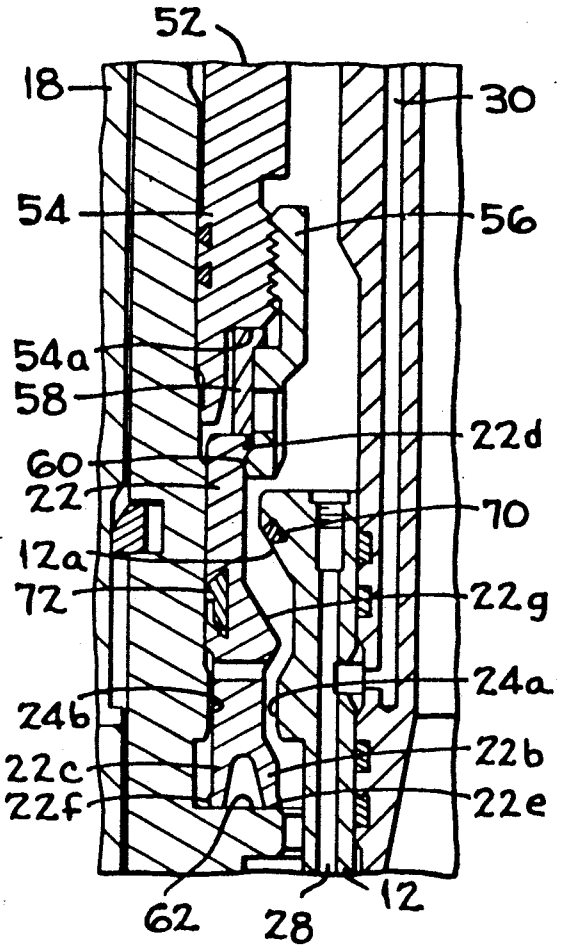
FIG. 6 is a view like FIGS. 3–5, showing the annulus valve in its fully open position and with the valve retractor ring engaged.

In moving from the FIG. 5 to FIG. 6 positions, the annular rib 60 of the retractor ring 56 moves inside and underneath the valve element rib 22*b*, and the stop ring 58 comes to rest on top of the valve element 22. At this point the ribs 60 and 22*b* are in cooperative engagement for lifting the valve element 22 towards its closed position.

Figure 4:
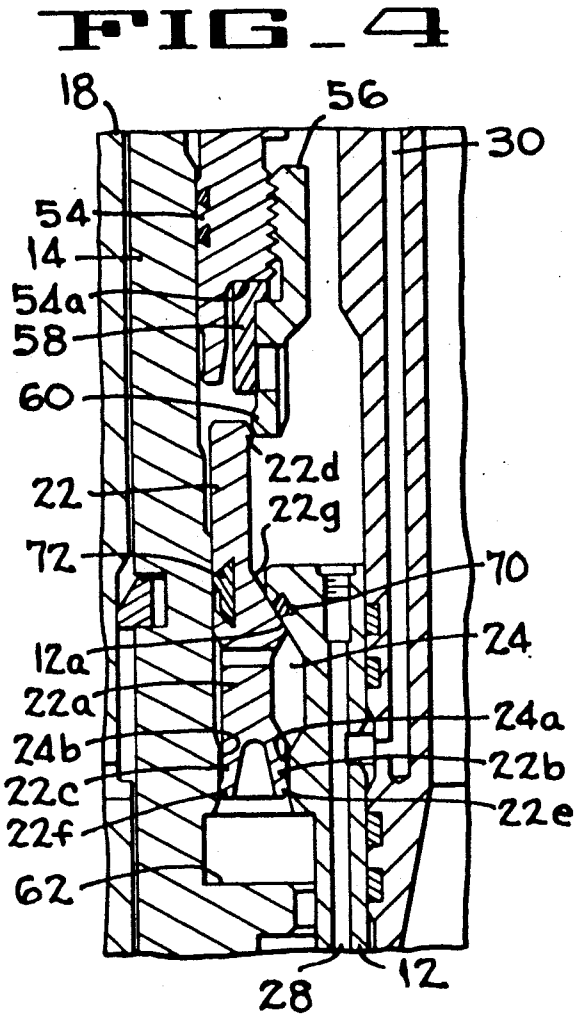
FIG. 4 is a view like FIG. 3, showing the valve retractor ring in position against the annulus valve, but prior to moving the valve from its fully closed position.
Figure 7:
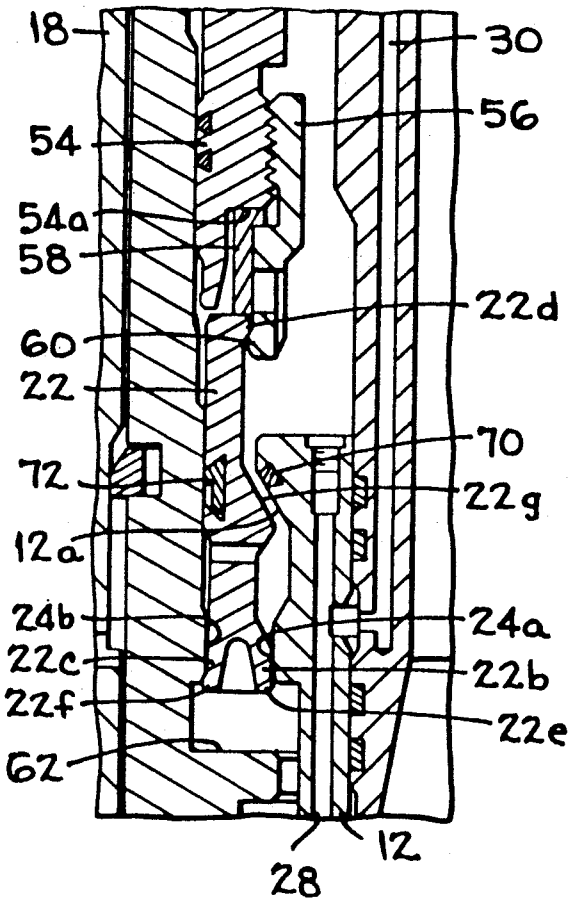
FIG. 7 is a view like FIGS. 3–6, showing the annulus valve approaching its fully closed position and still engaged with the valve retractor ring.

Closing off the well annulus is achieved by lifting the sleeve 52, and thus the annulus valve element 22, from their FIG. 6 position until the valve element reaches its position shown in FIG. 7. An inner frusto-conical surface 22*g* on the valve element 22 functions as a stop that prevents further upward movement of the valve element when the surface 22*g* contacts an opposing frusto-conical surface 12*a* on the hanger inner body 12 (FIG. 4). In this closed position an annular resilient seal 70 in the inner body surface 12*a*, and another annular resilient seal 72 in the outer surface of the valve element 22, provide secondary or backup seals between the valve element and the upper end area of the chamber 24.

Figure 3:
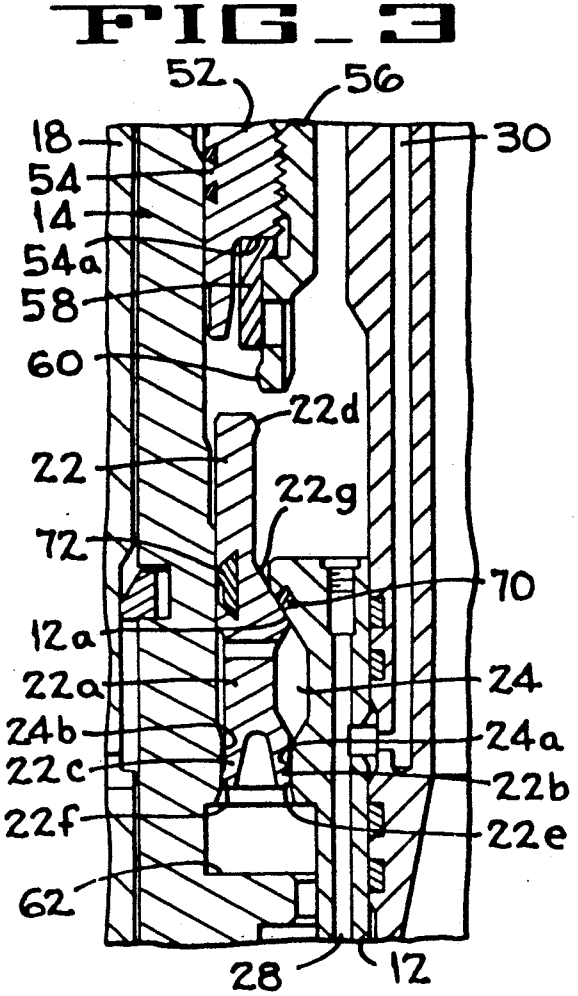
FIG. 3 is an enlarged fragmentary sectional view of the annulus valve, the tubing hanger, and the adjacent well components illustrated in the left half of FIG. 2, showing the valve in its fully closed position and the valve operating sleeve in position for starting its descent to the annulus valve.
Figure 8:
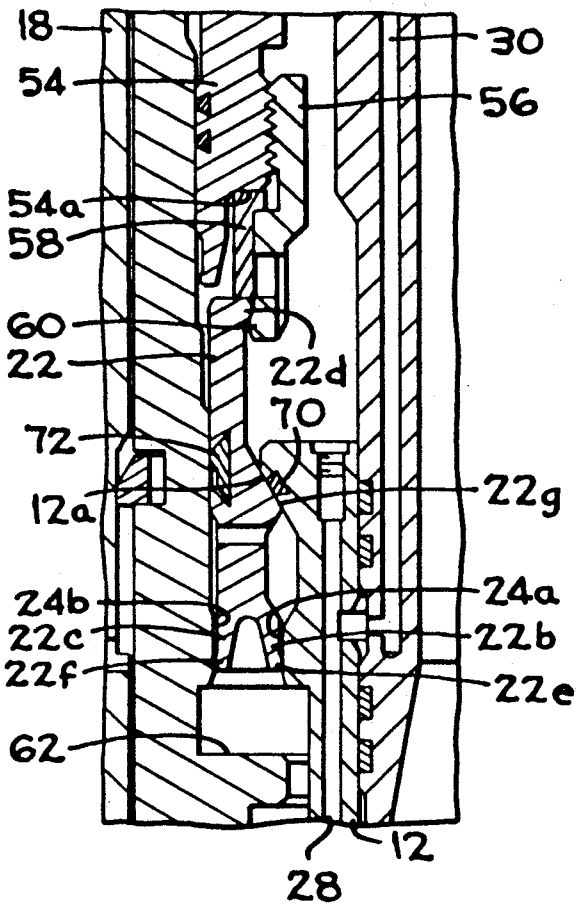
FIG. 8 is a view like FIGS. 3–7, showing the annulus valve in its fully closed position but still engaged with the valve retractor ring.

Disengagement of the sleeve 52 from the valve element 22 is accomplished merely by further lifting of the sleeve from its FIG. 8 position into its FIG. 3 position. As this occurs the rib 60 is pulled from underneath and then past the rib 22*b*, thereby freeing the tool 52 for retrieval from the well.

It should be noted that the apparatus described above comprises a "fail as is" mechanism, which means that should hydraulic components (not shown) of the system for operating the annulus valve sleeve 52 fail, the annulus valve will not shift from the position it was in when such failure occurred. However, it also should be understood that if a "fail open" or "fail closed" system is desired, it can be accommodated in this design by including a spring or similar mechanism to bias the action of the operating system. Also, a notable feature of the annulus valve operating sleeve 52 is that the metal seals can be stroked under pressure.

Although the best mode contemplated for carrying out the present invention has been herein shown and described, it will be apparent that modification and variation may be made without departing from what is regarded to be the subject matter of the invention.

What is claimed is:

1. A well pipe hanger with a metal sealing annulus closure system, said hanger comprising:

a) an annular hanger body;

b) means to support the hanger body within a surrounding hanger receptacle;

c) an annular valve chamber defined by radially spaced and opposed axial surfaces within the hanger body, said chamber having two radially spaced and opposed annular metal sealing surfaces;

d) passageway means for providing communication between the chamber and a well annulus below the hanger when the hanger body is in functional position within said hanger receptacle;

e) an annular metal annulus valve closure element within the hanger body chamber for movement with respect thereto, said valve element having two annular metal sealing surfaces for cooperation with said chamber sealing surfaces to establish a metal-to-metal seal therebetween when said valve closure element is in its closed position; and f) means on the valve closure element to accept a force for mechanically moving said closure element between its open and closed positions.

2. A well pipe hanger according to claim 1 wherein the valve chamber sealing surfaces are cylindrical.

3. A well pipe hanger according to claim 1 wherein the valve element sealing surfaces comprise annular ribs.

4. A well pipe hanger according to claim 1 wherein the valve element sealing surfaces have a radiused cross-sectional configuration.

5. A well pipe hanger according to claim 1 wherein the valve element includes two annular sealing lips, and wherein the valve element sealing surfaces comprise annular ribs on said lips.

6. A well pipe hanger according to claim 5 wherein the ribs have a radiused cross-sectional configuration.

7. A well pipe hanger according to claim 1 wherein the annulus valve element includes a stop means that cooperates with the hanger body to stop the annular sealing surfaces of said valve element in their functionally closed position.

8. A well pipe hanger according to claim 1 wherein the force-accepting means on the valve element comprises an annular rib providing an abutment against which a valve-opening axial force can be exerted.

9. A well pipe hanger according to claim 8 wherein the annular rib cooperates with means on a valve element operating tool to releasably engage the valve element for moving said element into its closed position.

10. A well pipe hanger according to claim 9 wherein the means on the valve element operating tool to engage the valve element comprises an annular rib.

11. A well pipe hanger according to claim 1 wherein the valve element sealing surfaces are located on a pair of sealing lips that extend from a body portion of said element.

12. A well pipe hanger according to claim 1 wherein the valve closure element annular metal sealing surfaces are on axially-extending valve closure element lips that cooperate with a valve chamber surface to stop the valve closure element in its fully open position.

13. A well pipe hanger according to claim 1 including a mechanism for rigidly locking the hanger in the surrounding hanger receptacle, said locking mechanism comprising a locking mandrel surrounding the hanger body and axially movable with respect thereto, an axially-split locking ring surrounding the hanger body for expansion into engagement with said hanger receptacle in response to axial movement of said locking mandrel, and means on said hanger body to limit axial movement of said locking ring with respect thereto.

14. A well pipe hanger according to claim 13 wherein the locking ring is L-shaped in cross-sectional configuration.

15. A well pipe hanger according to claim 14 wherein axial movement of the locking mandrel towards the locking ring causes the mandrel to move inside the ring and cam the ring from its contracted into its functional expanded condition.

16. A well pipe hanger according to claim 13 wherein the means to limit axial movement of the locking ring comprises a reaction ring surrounding and secured to the hanger body.

17. A well pipe hanger according to claim 16 wherein the reaction ring is axially adjustable on the hanger body.

18. A well pipe hanger according to claim 16 wherein the hanger body, hanger locking mandrel, locking ring, reaction ring and surrounding hanger receptacle cooperate to create hoop deflection of the locking mandrel to generate a pre-load in the locking system when functionally engaged.

19. A well pipe hanger according to claim 18 wherein the interface of the locking mandrel and locking ring is cylindrical, and whereby the pre-load generated in the locking of the hanger to the receptacle creates a friction lock therebetween.

20. A well pipe hanger according to claim 19 wherein the mechanical lock achieved between the hanger and its receptacle increases in effectiveness as force generated below the hanger increases.

21. A well pipe hanger according to claim 18 wherein the interface of the locking mandrel and locking ring is tapered, and whereby said interface is self-locking as a function of friction.

22. A well pipe hanger according to claim 21 whereby the mechanical lock achieved between the hanger and its receptacle increases in effectiveness as force generated below the hanger increases.

23. A well pipe hanger according to claim 1 wherein the valve closure element includes a pair of annular sealing lips that respond to well pressure from below said valve closure element to intensify the seal between said lips and the valve chamber.

24. A well pipe hanger according to claim 23 wherein the sealing lips respond to pressure from above the valve element to release their sealing engagement with the valve chamber.

25. A well pipe hanger according to claim 1 wherein the valve closure element can be moved into its open position against differential pressure exerted thereagainst.

26. A well pipe hanger according to claim 1 wherein the valve closure element can be moved into its closed position while fluid is flowing through the valve chamber.

27. A well pipe hanger according to claim 1 wherein the valve closure system can be leak tested from beneath the valve closure element.

* * * * *